US008348652B2

(12) United States Patent
Huang

(10) Patent No.: US 8,348,652 B2
(45) Date of Patent: Jan. 8, 2013

(54) APPARATUS FOR MANUFACTURING NONWOVEN FABRIC

(75) Inventor: Tzu-Hsiang Huang, Taipei Hsien (TW)

(73) Assignee: Taiwan Textile Research Institute, New Taipei (TW)

( * ) Notice: Subject to any disclaimer, the term of this patent is extended or adjusted under 35 U.S.C. 154(b) by 499 days.

(21) Appl. No.: 12/613,857

(22) Filed: Nov. 6, 2009

(65) Prior Publication Data

US 2011/0038973 A1 Feb. 17, 2011

(30) Foreign Application Priority Data

Aug. 13, 2009 (TW) ..... 98127287 A

(51) Int. Cl.
*D01D 5/12* (2006.01)
*D04H 3/02* (2006.01)

(52) U.S. Cl. ..... 425/66; 425/71; 425/72.2; 425/83.1

(58) Field of Classification Search ..... 425/66, 425/71, 72.2, 83.1
See application file for complete search history.

(56) References Cited

U.S. PATENT DOCUMENTS 5,366,793 A 11/1994 Fitts, Jr. et al.
5,439,364 A * 8/1995 Gerking et al. ..... 425/66
6,013,223 A 1/2000 Schwarz
6,306,334 B1 10/2001 Luo et al.
6,499,981 B1 * 12/2002 Yoshida ..... 425/66
2003/0160348 A1 * 8/2003 Zikeli et al. ..... 264/70
2007/0134478 A1 * 6/2007 Haberer et al. ..... 428/219
2009/0026647 A1 * 1/2009 Geus et al. ..... 264/40.6

FOREIGN PATENT DOCUMENTS

CN 101235580 8/2008
EP 1936017 A1 * 6/2008
TW 555903 10/2003
TW 200928033 7/2009

OTHER PUBLICATIONS

"Office Action of Taiwan Counterpart Application", issued on Jul. 27, 2012, p1-p6, in which the listed references were cited.

* cited by examiner

*Primary Examiner* — Yogendra Gupta
*Assistant Examiner* — Joseph Leyson
(74) *Attorney, Agent, or Firm* — J.C. Patents

(57) ABSTRACT

An apparatus for manufacturing nonwoven fabric including a spinning nozzle, a fiber extension device, a receiver device and a sprinkler is provided. The spinning nozzle is filled with a spinning solution and has a plurality of spinners, where each of the spinners includes a spinning port and a main gas port surrounding the spinning port. The fiber extension device is disposed under the spinning nozzle and includes at least one secondary gas supply device. The secondary gas supply device has an arc gas distribution portion, such that the direction of gas ejected from the secondary gas supply device is the same as the direction of gas ejected from the main gas port. The receiver device is disposed under the fiber extension device. The sprinkler is disposed above the fiber extension device or the receiver device.

6 Claims, 6 Drawing Sheets

APPARATUS FOR MANUFACTURING NONWOVEN FABRIC

CROSS-REFERENCE TO RELATED APPLICATION

This application claims the priority benefit of Taiwan application serial no. 98127287, filed on Aug. 13, 2009. The entirety of the above-mentioned patent application is hereby incorporated by reference herein and made a part of specification.

BACKGROUND OF THE INVENTION

1. Field of the Invention

The invention relates to an apparatus for manufacturing a fiber product. More particularly, the invention relates to an apparatus for manufacturing a nonwoven fabric.

2. Description of Related Art

Nonwoven fabric is one of the applications of artificial fibers, and the process combines techniques and principles of plastics, chemical engineering, papermaking and textiles and so on. Such application of artificial fibers is referred to as a "nonwoven fabric", as it is not manufactured by conventional weaving methods, such as weaving or knitting. The nonwoven fabric is endowed with properties such as soft texture, low thermal conductibility, superior gas permeability, moisture absorption, humectation, and dust-proof. Accordingly, the nonwoven fabric is extremely widely used, and adopted in various industries, such as agriculture, construction, people's livelihood, industry, medicine, automobile, as the material for wiping, moisture absorbing, filtering, and other functions.

Conventional methods of manufacturing nonwoven fabric include the Lyocell process, for example. In the Lyocell process, N-methylmorpholinoxide (NMMO) is used as a solvent for dissolving cellulose pulp. The solution is then extruded from a melt spinner in threads under 70° C.~140° C. Moreover, water is adopted as a coagulation bath displacement solvent to regenerate the cellulose. Comparing to known organic solvents that evaporate and cause environmental pollution, the feature of the Lyocell process is that NMMO does not evaporate, so that the fiber manufacturing process satisfies environmental protection requirements. However, when enhancing the spinning speed, the main gas provided by the melt spinner can not extend the fibers to have a sufficient length and a sufficiently thin thickness, such that the fibers generated have large diameter and uneven netted structures. Hence, the yield can not be enhanced.

SUMMARY OF THE INVENTION

The invention is directed to an apparatus for manufacturing a nonwoven fabric, and the apparatus is capable of increasing an extension efficiency of a spinning solution.

The invention is directed to an apparatus for manufacturing a nonwoven fabric. The apparatus includes a spinning nozzle, a fiber extension device, a receiver device, and a sprinkler device. The spinning nozzle is filled with a spinning solution and has a plurality of spinners. Moreover, each of the spinners includes a spinning port and a main gas port surrounding the spinning port. The fiber extension device is disposed under the spinning nozzle and includes at least one secondary gas supply device. The secondary gas supply device has an arc gas distribution portion, such that a direction of a gas ejected from the secondary gas supply device is identical to a direction of a gas ejected from the main gas port. The receiver device is disposed under the fiber extension device. The sprinkler is disposed above the fiber extension device or the receiver device.

According to an embodiment of the invention, the secondary gas supply device of the fiber extension device is a single-sided secondary gas supply device.

According to an embodiment of the invention, the single-sided secondary gas supply device has a single secondary gas port or a multiple secondary gas port.

According to an embodiment of the invention, the secondary gas supply device of the fiber extension device is a double-sided secondary gas supply device.

According to an embodiment of the invention, the double-sided secondary gas supply device has a single secondary gas port or a multiple secondary gas port on each side.

According to an embodiment of the invention, the secondary gas ports on the sides are symmetrically disposed.

According to an embodiment of the invention, the secondary gas ports on the sides are asymmetrically disposed.

According to an embodiment of the invention, a flow rate of the gas ejected from the main gas port is 5~30 m/s.

According to an embodiment of the invention, a flow rate of the gas ejected from the secondary gas supply device is 10~50 m/s.

According to an embodiment of the invention, a distance between the main gas port and the secondary gas supply device is 5~70 cm.

According to an embodiment of the invention, the spinning solution includes a solvent and a fiber material dissolved in the solvent. The solvent includes N-methylmorpholinoxide (NMMO) and the fiber material includes cellulose.

According to an embodiment of the invention, the spinning solution includes a solvent and a thermoplastic polymer dissolved in the solvent.

According to an embodiment of the invention, the receiver device is a roller receiver device.

According to an embodiment of the invention, the sprinkler sprinkles water in a manner of a plurality of water columns, a plurality of sprays, or at least a continuous water wall.

In light of the foregoing, the direction of the gas ejected from the secondary gas supply device is the same as the direction of the gas ejected from the main gas port. Hence, the speed of the spinning solution can be enhanced, so as to double-extend the spinning solution, thereby increasing the extension efficiency of the spinning solution.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
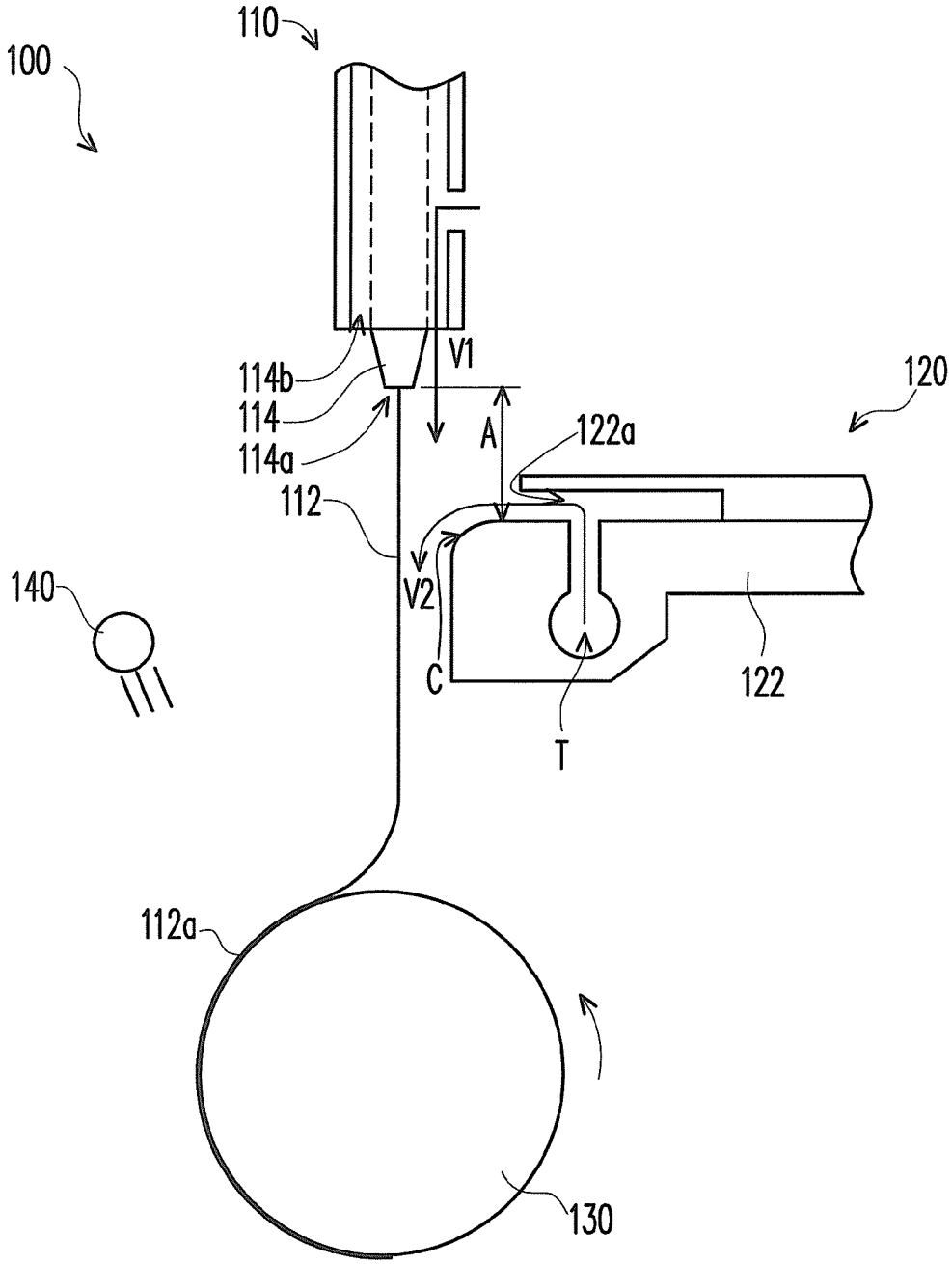
FIG. 1 illustrates a schematic view of an apparatus for manufacturing a nonwoven fabric according to an embodiment of the invention.

FIG. 1 illustrates a schematic view of an apparatus for manufacturing a nonwoven fabric according to an embodiment of the invention. FIGS. 2~6 illustrate five variations of the structure of the apparatus for manufacturing the nonwoven fabric according to FIG. 1.

Referring to FIG. 1, an apparatus 100 for manufacturing a nonwoven fabric of the present embodiment includes a spinning nozzle 110, a fiber extension device 120, a receiver device 130, and a sprinkler 140. The spinning nozzle 110 is filled with a spinning solution 112 and has a plurality of spinners 114 (to simplify illustration, only one spinner 114 is shown in FIG. 1). Each spinner 114 includes a spinning port 114*a* and a main gas port 114*b* surrounding the spinning port 114*a*. A flow rate of the gas ejected from the main gas port 114*b* is 5~30 m/s, for example.

The spinning solution 112 includes a solvent and a thermoplastic polymer dissolved in the solvent. In the present embodiment, the solvent is N-methylmorpholinoxide (NMMO), for example, and the thermoplastic polymer is a fiber material (i.e. cellulose). In other embodiments, the thermoplastic polymer is a thermoplastic material such as polypropylene (PP), polyethylene (PE), polyethylene terephthalate (PET), polybutylene terephthalate (PBT), nylon, poly urethane, and the like. The solvent is a solvent suitable for dissolving thermoplastic material.

The fiber extension device 120 is disposed under the spinning nozzle 110. The fiber extension device 120 includes a secondary gas supply device 122. A distance A between the main gas port 114*b* and the secondary gas supply device 122 is 5~70 cm, for instance. The secondary gas supply device 122 has an arc gas distribution portion C. The arc gas distribution portion C is located on an edge of the spinning solution 112 (ejected from the spinning port 114*a*) neighboring to the secondary gas supply device 122. A wall attachment effect (also known as the Coanda effect) of the gas allows a gas ejected from the secondary gas supply device 122 to flow along a surface of the arc gas distribution portion C. Consequently, a direction V2 of the gas ejected from the secondary gas supply device 122 is the same as a direction V1 of the gas ejected from the main gas port 114*b*. A flow rate of the gas ejected from the secondary gas supply device 122 is 10~50 m/s, for example.

It should be noted that the speed of the spinning solution 112 is gradually reduced after the spinning solution 112 is ejected from the spinning port 114*a*. In the present embodiment, the direction V2 of the gas ejected from the secondary gas supply device 122 is identical to the direction V1 of the gas (ejected from the main port 114*b*). Therefore, the speed of the spinning solution 112 is enhanced, so that the spinning solution 112 remains in a high-speed falling state. The spinning solution 112 can then be double-extended. Hence, the extension efficiency of the spinning solution 112 is increased and the yield of fiber subsequently produced from the spinning solution 112 is enhanced. Since the diameter of the fiber aforementioned is smaller, the evenness and the strength of the nonwoven fabric composed by the fibers aforementioned are higher.

The receiver device 130 is disposed under the fiber extension device 120. The receiver device 130, for example, is a roller receiver device. The sprinkler 140 is disposed above the fiber extension device 120 or the receiver device 130. In order to simplify illustration, FIG. 1 merely illustrates the sprinkler 140 disposed above the receiver device 130. The sprinkler 140 sprinkles water in a manner of a plurality of water columns, a plurality of sprays, or at least one continuous water wall, or other suitable sprinkling manners.

In details, when the sprinkler 140 is disposed above the receiver device 130, the spinning solution 112 is first extended by the fiber extension device 120 and then drips on the receiver device 130. The spinning solution 112 is then sprinkled by the sprinkler 140 to coagulate, thereby forming a plurality of fibers 112*a*. When the sprinkler 140 is disposed above the fiber extension device 120, the spinning solution 112 is first coagulated from the sprinkling of the sprinkler 140, so as to final a plurality of fibers 112*a*. Thereafter, the fiber extension device 120 is utilized to extend the fibers 112*a*.

Figure 2:
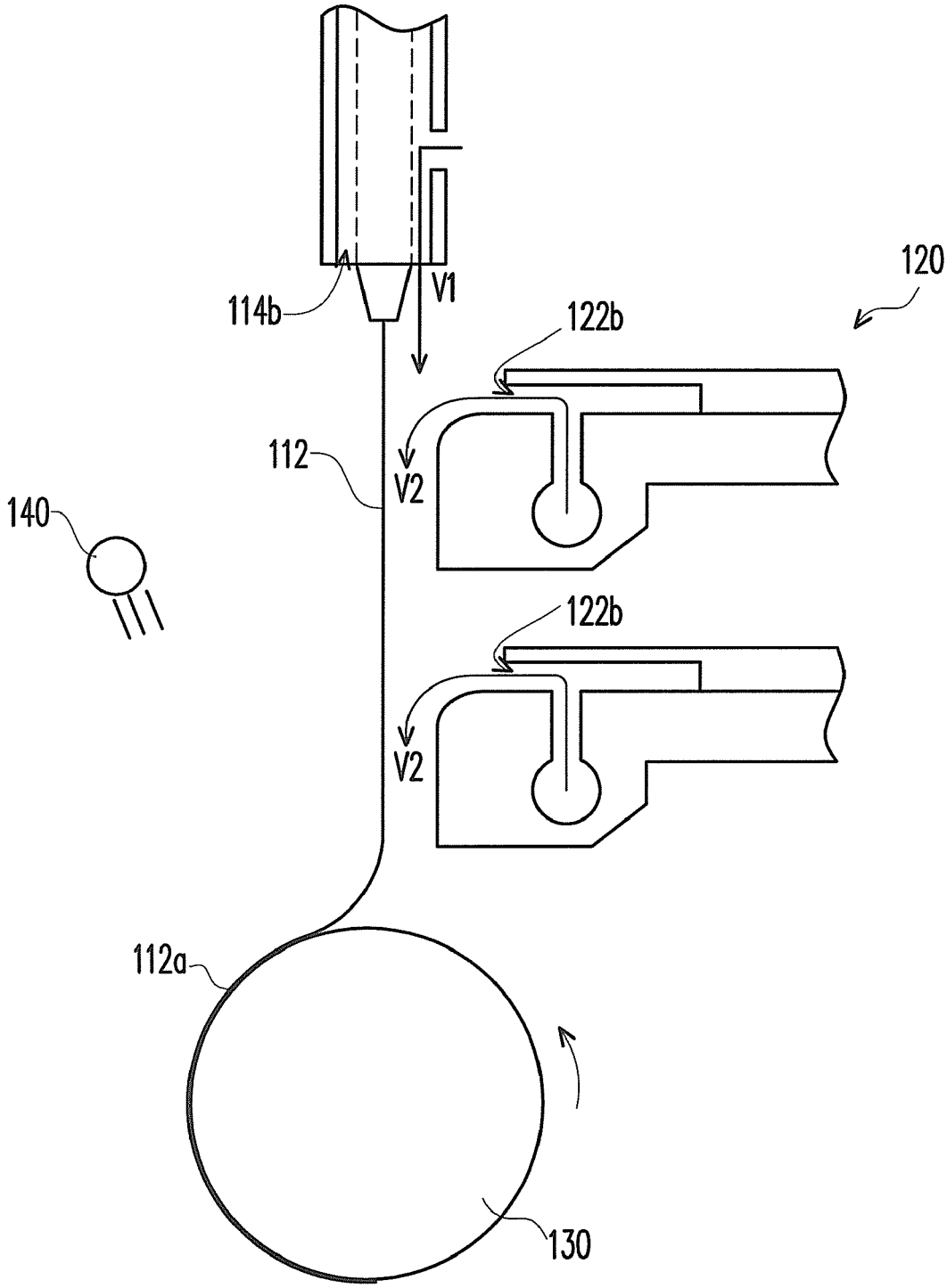
FIGS. 2~6 illustrate five variations of the structure of the apparatus for manufacturing the nonwoven fabric according to FIG. 1.

In addition, in the present embodiment, the secondary gas supply device 122 of the fiber extension device 120 is a single-sided secondary gas supply device. The single-sided secondary gas supply device has a single secondary gas port 122*a* or a multiple secondary gas port 122*b* (as shown in FIG. 2). In details, the single-sided secondary gas supply device has a gas tunnel T connecting to a gas source (not shown). The gas can flow from the gas tunnel T to the secondary gas ports 122*a*, 122*b*. The multiple secondary gas ports 122*b* are aligned along the direction V1 of the gas (ejected from the main gas port 114*b*), so as to enhance the speed of the spinning solution 112 in the direction V1 of the gas. In other embodiments, the secondary gas supply device 122 of the fiber extension device 120 can also be a double-sided secondary gas supply device D1, D2, D3, or D4 (as shown in FIGS. 3~6).

Figure 3:
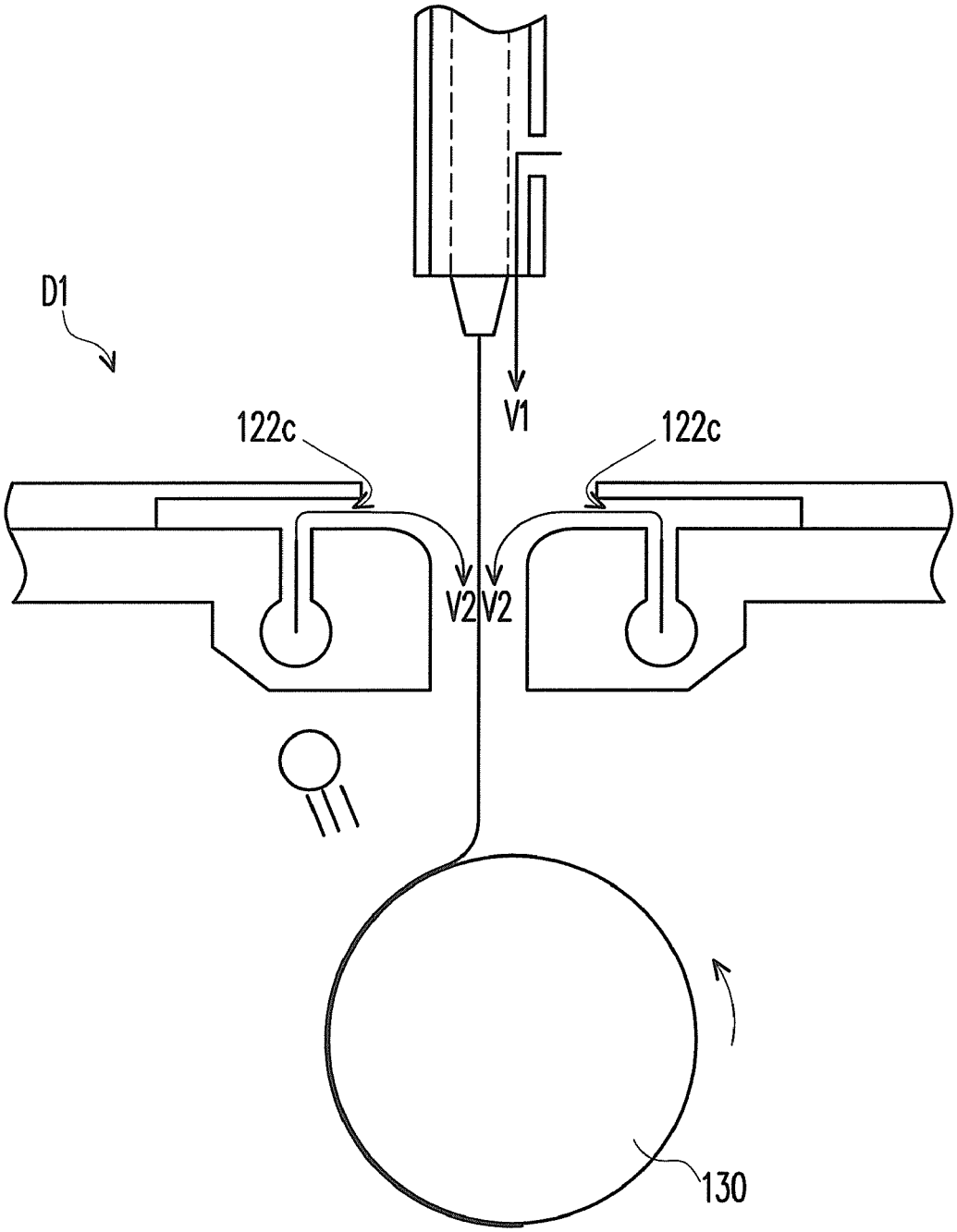

Referring to FIG. 3, the double-sided secondary gas supply device D1 has a single secondary gas port 122*c* on each side, and the secondary gas ports 122*c* on the sides are symmetrically disposed. In the embodiment of FIG. 3, the symmetrically disposed secondary gas ports 122*c* means that the secondary gas ports 122*c* located on the sides have the same height relative to the receiver device 130.

Figure 4:
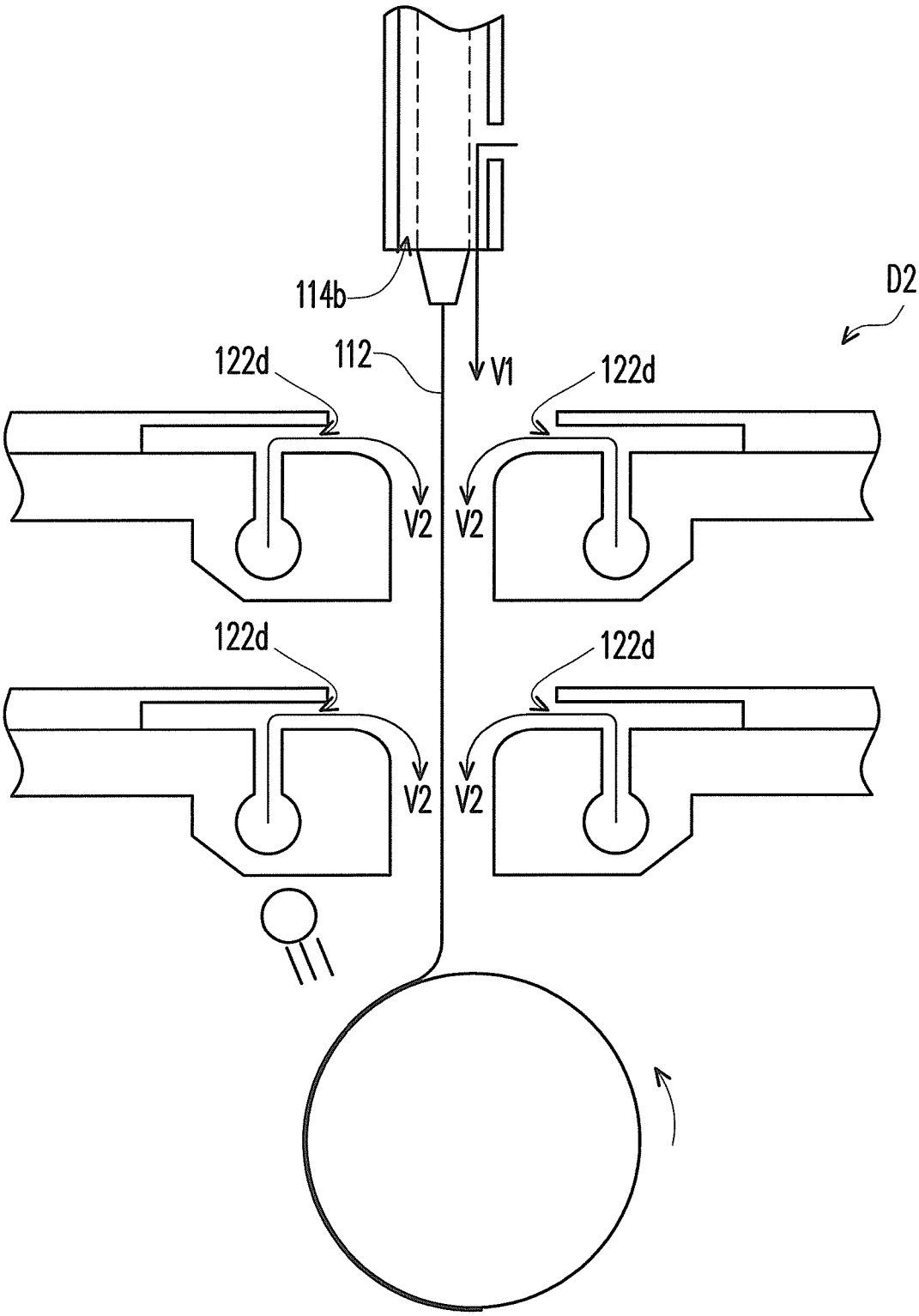

Referring to FIG. 4, the double-sided secondary gas supply device D2 has a multiple secondary gas port 122*d* on each side. The multiple secondary gas ports 122*d* are aligned in the direction V1 of the gas (ejected from the main gas port 114*b*), so as to enhance the speed of the spinning solution 112 in the direction V1 of the gas. The secondary gas ports 122*d* located on the sides are symmetrically disposed.

Figure 5:
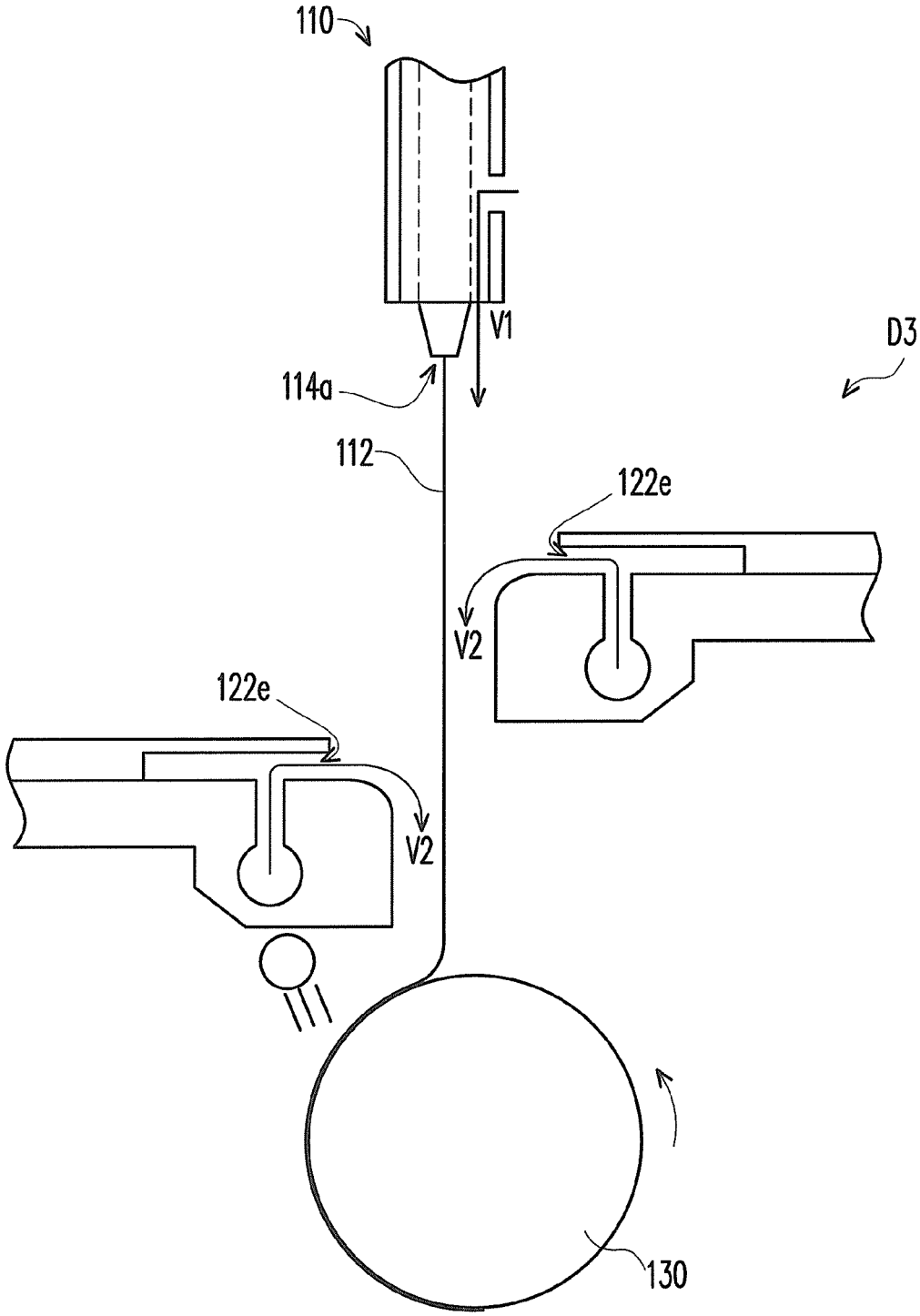

Referring to FIG. 5, the double-sided secondary gas supply device D3 has a single secondary gas port 122*e* on each side, and the secondary gas ports 122*e* on the sides are asymmetrically disposed. Specifically, the secondary gas ports 122*e* located on the sides are aligned along the direction V1 and the heights of the secondary gas ports 122*e* relative to the receiver device 130 are not the same. In the embodiment in FIG. 5, a secondary gas port 122*e* is disposed on each side of the spinning solution 112 (ejected from the spinning port 114*a*). A height of the left secondary gas port 122*e* relative to the receiver device 130 is smaller than a height of the right secondary gas port 122*e* relative to the receiver device 130.

Figure 6:
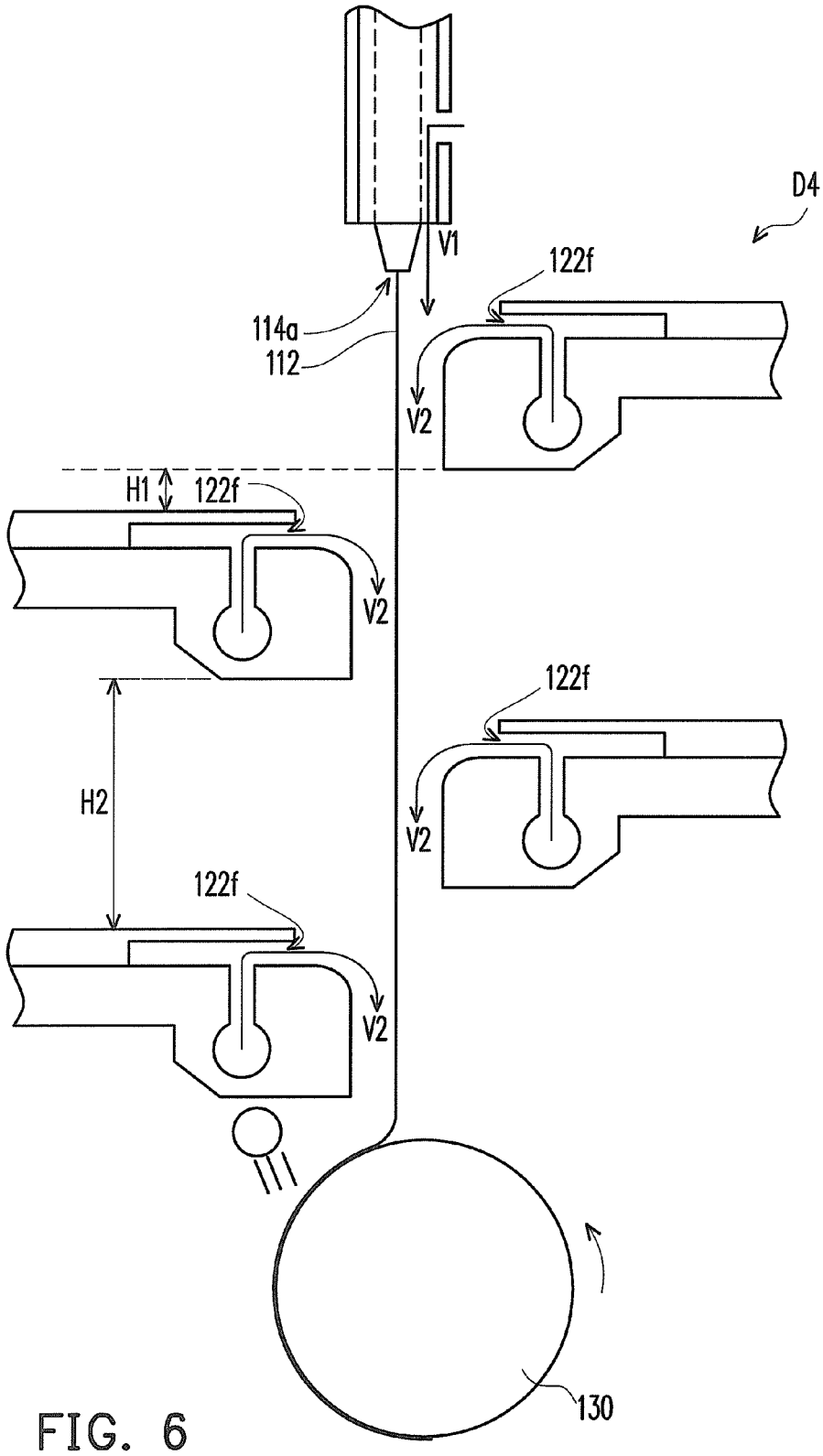

Referring to FIG. 6, the double-sided secondary gas supply device D4 has a multiple secondary gas port 122*f* on each side, and the secondary gas ports 122*f* on the sides are asymmetrically disposed. Specifically, the secondary gas ports 122*f* on the respective sides are aligned along the direction V1 of the gas and have a height difference H1 therebetween. The secondary gas ports 122*f* on the same side are aligned along the direction V1 of the gas and have a height difference H2 therebetween. In the embodiment in FIG. 6, two secondary gas ports 122*f* are disposed on each side of the spinning solution 112 (ejected from the spinning port 114*a*). Moreover, heights of the four secondary gas ports 122*f* relative to the receiver device 130 are all different.

Table 1 illustrates various experimental conditions of two examples performed by using the apparatus 100 for manufacturing the nonwoven fabric in the present embodiment. Table 2 shows the experimental results of the two examples in Table 1.

TABLE 1

| Example | Volume extruded from a single port (192 ports) | Flow rate of main gas (m/s) | Flow rate of secondary gas (m/s) |
|---|---|---|---|
| 1 | 100 cc/min | 10 | 0 |
| 2 | 100 cc/min | 10 | 30 |

TABLE 2

| Example | Average fiber diameter (μm) | Strength of nonwoven fabric (Kgf) |
|---|---|---|
| 1 | 14 | 0.8 |
| 2 | 10 | 2.2 |

As illustrated in Table 1, the secondary gas supply device 122 is turned off in Example 1 to simulate the a conventional apparatus for manufacturing the nonwoven fabric. However, the secondary gas supply device 122 is utilized in Example 2. Therefore, in Table 2, the experimental results of Example 1 show the average fiber diameter and strength of nonwoven fabric of a conventional nonwoven fabric. On the other hand, the experimental results of Example 2 show the average fiber diameter and strength of nonwoven fabric of a nonwoven fabric manufactured by additionally performing the double-extension using the secondary gas supply device 122 of the present embodiment.

As shown in Table 2, the average fiber diameter of the nonwoven fabric manufactured in Example 2 is smaller than the average fiber diameter of the nonwoven fabric manufactured in Example 1. In addition, the strength of the nonwoven fabric manufactured in Example 2 is greater than the strength of the nonwoven fabric manufactured in Example t 1. In other words, the secondary gas supply device 122 of the present embodiment facilitates the extension efficiency of the spinning solution and reduces the average fiber diameter of the nonwoven fabric, so as to facilitate in enhancing the evenness and strength of the nonwoven fabric.

In summary, as the direction of the gas ejected from the secondary gas supply device is the same as the direction of the gas ejected from the main gas port in the invention, the speed of the spinning solution can be enhanced, so as to double-extend the spinning solution. Hence, the extension efficiency of the spinning solution is increased and the yield of fiber is enhanced. Since the diameter of the fiber aforementioned is smaller, the evenness and the strength of the nonwoven fabric composed by the fiber aforementioned are both higher.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An apparatus for manufacturing a nonwoven fabric, comprising:

a spinning nozzle, filled with a spinning solution, wherein the spinning nozzle has a plurality of spinners and each of the plurality of spinners comprises a spinning port and a main gas port surrounding the spinning port;

a fiber extension device, disposed under the spinning nozzle and comprising at least one secondary gas supply device, wherein the secondary gas supply device has an arc gas distribution portion, such that a direction of a gas ejected from the secondary gas supply device is identical to a direction of a gas ejected from the main gas port, wherein the secondary gas supply device of the fiber extension device is a double-sided secondary gas supply device having a plurality of secondary gas ports on each side, and the plurality of secondary gas ports are asymmetrically disposed on the two sides;

a receiver device, disposed under the fiber extension device; and a sprinkler, disposed above the fiber extension device or the receiver device.

2. The apparatus for manufacturing the nonwoven fabric as claimed in claim 1, wherein a flow rate of the gas ejected from the main gas port is 5~30 m/s.

3. The apparatus for manufacturing the nonwoven fabric as claimed in claim 1, wherein a flow rate of the gas ejected from the secondary gas supply device is 10~50 m/s.

4. The apparatus for manufacturing the nonwoven fabric as claimed in claim 1, wherein a distance between the main gas port and the secondary gas supply device is 5~70 cm.

5. The apparatus for manufacturing the nonwoven fabric as claimed in claim 1, wherein the receiver device is a roller receiver device.

6. The apparatus for manufacturing the nonwoven fabric as claimed in claim 1, wherein the sprinkler sprinkles water in a manner of a plurality of water columns, a plurality of sprays, or at least a continuous water wall.

* * * * *